US006969428B2

(12) United States Patent
Guiduzzi et al.

(10) Patent No.: US 6,969,428 B2
(45) Date of Patent: Nov. 29, 2005

(54) SELF-CLEANING SYSTEM FOR DRY RECOVERY OF PROCESSING MISTS IN AUTOMATIC MACHINES FOR SPRAYING PAINTS

(75) Inventors: Andrea Luca Guiduzzi, Massalombarda (IT); Luigi Franzoni, Imola (IT)

(73) Assignee: CEFLA Soc. Coop. a.r.l., (IT)

( * ) Notice: Subject to any disclaimer, the term of this patent is extended or adjusted under 35 U.S.C. 154(b) by 0 days.

(21) Appl. No.: 10/808,419

(22) Filed: Mar. 25, 2004

(65) Prior Publication Data

US 2004/0187774 A1 Sep. 30, 2004

(30) Foreign Application Priority Data

Mar. 28, 2003 (IT) ..... BO20030032 U

(51) Int. Cl.[7] ..... B05B 15/12; B05B 15/04
(52) U.S. Cl. ..... 118/326; 55/DIG. 46
(58) Field of Search ..... 118/326, 309, DIG. 7; 55/DIG. 46; 454/50, 53

(56) References Cited

U.S. PATENT DOCUMENTS

| | | | | |
|---|---|---|---|---|
| 5,279,631 | A * | 1/1994 | Pingel | 55/294 |
| 5,720,811 | A * | 2/1998 | Eder | 118/64 |
| 6,264,547 | B1 * | 7/2001 | Walti | 454/52 |
| 6,447,609 | B1 * | 9/2002 | Potthoff | 118/70 |
| 6,585,793 | B2 * | 7/2003 | Richerson et al. | 55/521 |

* cited by examiner

*Primary Examiner*—Chris Fiorilla
*Assistant Examiner*—Yewebdar Tadesse
(74) *Attorney, Agent, or Firm*—Stites & Harbison PLLC; Marvin Petry

(57) ABSTRACT

Suitable corrugated filter grids (7, 7') are mounted on the suction intakes (6, 6') and are positioned with a downward inclination towards the conveyor (4) of the machine, their lower ends allowing drops to fall on to this conveyor. The suction intakes contain further removable filters (9, 9') and the lower ends of the said intakes are connected to a horizontal collector (10) which is positioned transversely under the conveyor of the machine and whose lower walls are inclined and converge towards a lower area in which is provided a tank (11) which collects all the paint precipitated by the filters located in the suction intakes and which is attached to the inner walls of the system by contact and by impact. An aperture (12) is provided in the intermediate part of one side of the said collector and is connected to a horizontal duct (13) of suitable section, which extends under the supply or discharge conveyor of the spraying machine and which has an extension at ninety degrees departing from the outline in plan view of this conveyor and connected to an ascending duct (14) connected by a bend to the suction intake of a centrifugal fan (16) whose outlet discharges into the atmosphere and which has a drainage duct (17) fitted on the lower part of its casing. The extension of this final part of the suction circuit also forms a trap for the recovery of further drops of paint carried by the air, and this circuit also has lower walls inclined downwards towards the said bottom tank (11) which collects the recovered paint by gravity.

16 Claims, 4 Drawing Sheets

1
2
3
4
5
6
7
7
10
11
13
14
101
104
110
111
113
204
P
P1
P2
F
T1
T2

SELF-CLEANING SYSTEM FOR DRY RECOVERY OF PROCESSING MISTS IN AUTOMATIC MACHINES FOR SPRAYING PAINTS

The invention relates to a self-cleaning system for the dry recovery of processing mists in an automatic spraying machine having a chamber through which passes a conveyor on which the products to be treated advance, and within which there operate spraying elements, movable about one or more axes, for spraying paints or other materials onto the products in transit. In particular, the invention relates to automatic machines designed for spraying acrylic paints with UV drying or other, typically oil-based, products, which remain fluid for a considerable time even in contact with the air. In the remainder of the description, the term "paint" will be used for the sake of brevity to denote any other product sprayed in the machine, even it is different from paint. In the known art, the chamber of the spraying machine is usually connected in its upper part to the atmosphere through ventilators and clean air admission filters, and in the said chamber suction intakes are provided at the sides of the conveyor on which the products to be painted advance, these intakes being connected to an external suction device with the interposition of dry filter means positioned in series in a plurality of stages, which at the present time require periodic operations of cleaning and maintenance by replacement of components, with a considerable effect on the costs of painting. The object of the invention is to provide a system of the dry self-cleaning type which permits rapid recovery of the processing mists in machines for spraying paints or other products with the same characteristics of prolonged fluidity. These and other objects are achieved with equipment which has, on the said suction intakes, corrugated filter grids, inclined towards the conveyor of the machine and positioned with their lower edges above the said conveyor. Each of these filter grids is formed from at least two superimposed corrugated sheets, with channels of various depths having their longitudinal axes orthogonal to the longitudinal axis of the machine, the said sheets having holes uniformly distributed and suitably staggered with respect to each other to form a labyrinthine path, in passing through which the air flow, carrying with it the spray paint mist, deposits the said paint by contact and by collision on the said corrugated grids, which channel the collected paint by gravity onto the upper branch of the machine conveyor, which removes it towards the recovery means which normally operate at the end of the conveyor, on its lower branch. Further removable filters, formed for example from panels of synthetic fabric or metal chips or staggered finned elements, are provided in the suction intakes, and the lower ends of the said intakes are connected to a horizontal collector, located transversely under the conveyor of the machine and having its lower walls inclined and converging towards a lower area in which is provided a tank which collects all the paint which falls from the filters located in the suction intakes and which by contact and by impact is attached and adheres to the walls of the said collector. In the intermediate part of one side of this collector there is provided an aperture to which is connected a horizontal duct of appropriate section, which extends under the supply or discharge conveyor of the spraying machine and which leaves the outline in plan view of this conveyor with a bend at ninety degrees and is connected to a rising duct connected by a bend to the suction intake of a centrifugal fan, with a horizontal axis, whose outlet discharges, for example, in an upward direction. The extension of this final part of the suction circuit also forms a trap for the recovery of further droplets of paint carried by the air, and this circuit also has lower walls inclined downwards towards the said bottom tank which collects the deposited paint by gravity. When the air reaches the final suction fan, comes into contact with its blades, and is centrifuged, the residual droplets of paint contained in the air are precipitated by impact and by centrifugal force and are retained by the casing of this fan, which can be made internally porous in order to enhance this process. The paint which accumulates in the lower part of the fan casing is evacuated by gravity through a drainage duct which discharges at a point of the system close to the said recovery tank, which is designed in such a way that it can be periodically emptied.

Further characteristics of the invention, and the advantages derived therefrom, will be made clear by the following description which refers to the figures of the attached sheets of drawings, in which.

Figure 1:
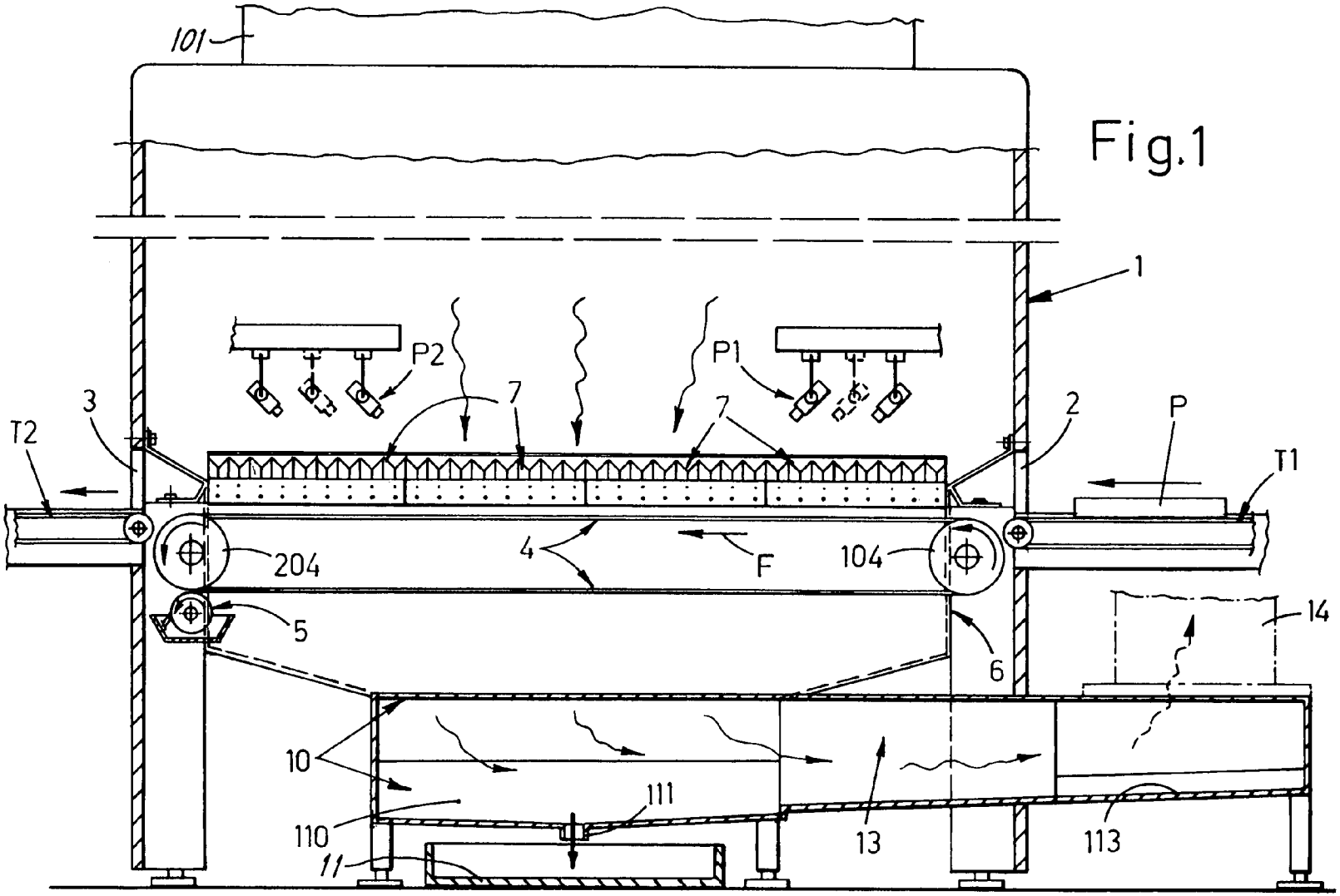
FIGS. 1 and 2 are views, in longitudinal and transverse section respectively, of a chamber-type spraying machine provided with the recovery system according to the invention.
Figure 2:
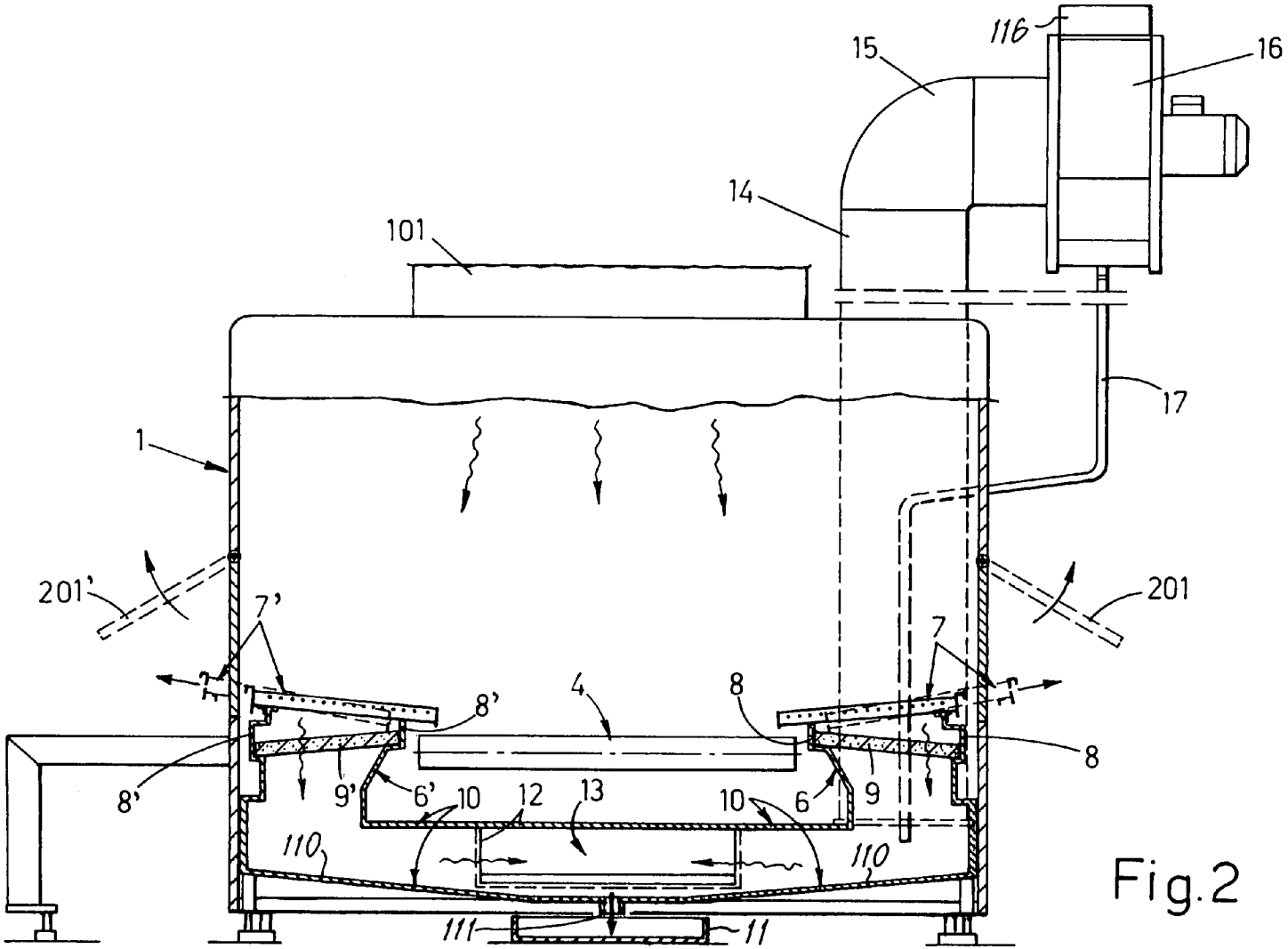

In FIGS. 1 and 2, the number 1 indicates the chamber of the spraying machine, which has a known upper part 101 designed to allow the forced and controllable introduction of filtered air from the external environment, and in which the opposite ends of the lower part have apertures 2 and 3 near which are positioned, inside or outside the said chamber, the end return rollers 104, 204 of a horizontal belt conveyor 4 which moves, for example, in the direction of the arrow F. The articles P to be painted are supplied to the conveyor 4 from an external conveyor T1, while a downstream external conveyor T2 collects and removes the articles which while travelling along the upper branch of the conveyor 4 are painted by spraying elements P1 and P2, each having six or four guns for example, which operate inside the chamber 1 and which are automatically controlled by known systems. Known means 5 operate on the lower branch of the belt conveyor 4, these means removing the paint not used on the painted articles from the said belt, enabling this paint to be recovered and allowing the said belt to return in a clean state to form the active upper branch.

Figure 4:
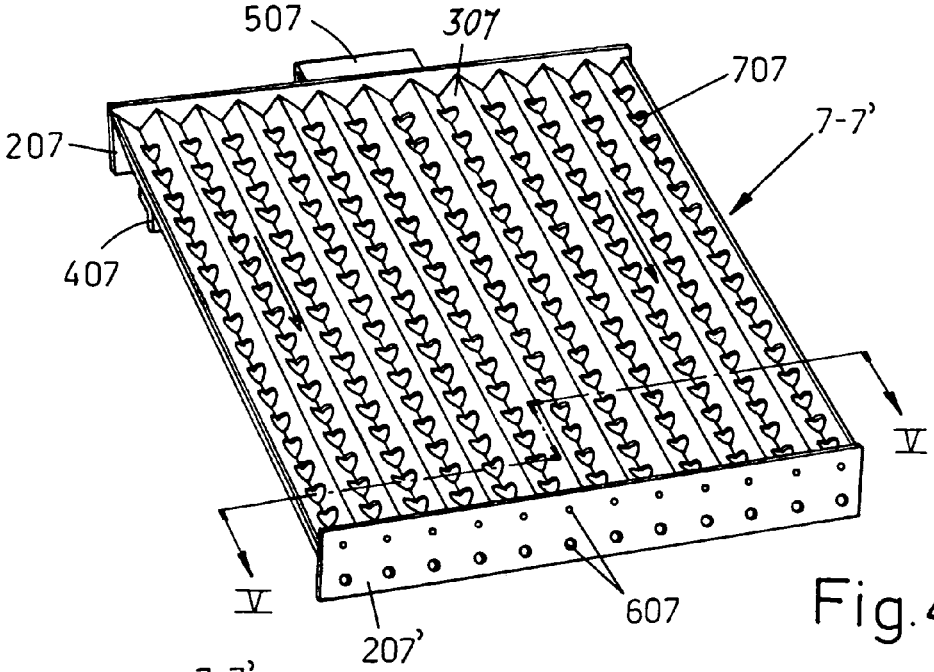
FIG. 4 is a perspective view of one of the corrugated filter grids mounted in an inclined position on the suction intakes operating inside the spraying machine.
Figure 5:
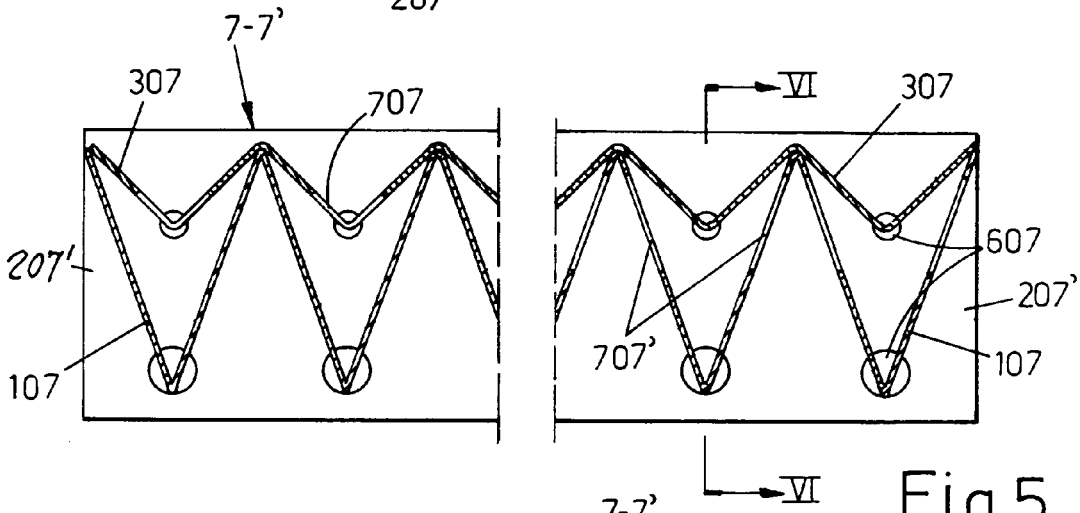
FIG. 5 shows other details of the filter grid of FIG. 4, in a cross section taken along the line V—V.
Figure 6:
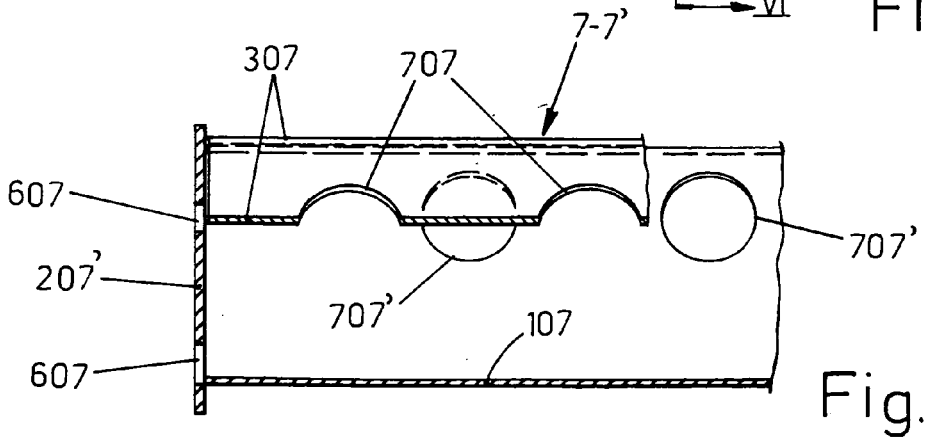
FIG. 6 shows other details of the filter grid of FIG. 5, in a longitudinal section taken along the line VI—VI.

Suction intakes 6, 6', made for example with metal frameworks, are provided in the chamber 1 at the sides of the conveyor 4, these intakes essentially having the same length as the chamber 1, being of rectangular shape and characterized by a transverse inclination which makes them converge downwards and towards the longitudinal median axis of the said conveyor. Filter grids 7, 7' of rectangular shape, positioned adjacent to each other in a sufficient number to cover the whole extension of the said intakes, are mounted removably on the intakes 6, 6'. The details in FIGS. 4, 5 and 6 show how each grid 7, 7' is formed by a lower cover 107 of corrugated stainless steel sheet or other suitable material, the corrugations having an internal angle of approximately 40° and oriented with their longitudinal axes orthogonal to the longitudinal axis of the conveyor 1 and having their ends fixed to flat cross-pieces 207, 207', also made from stainless steel, having heights greater than that of the corrugated profile of the sheet 107 in such a way that they project for a suitable distance both above and below the said sheet 107. Another corrugated sheet 307, also made from stainless steel, rests on top of the sheet 107, the corrugations of this upper sheet having the same pitch as those of the lower sheet but a larger angle, for example approximately 90°, in such a way that they bear on the vertices of the corrugations of the said lower sheet and are partially inserted between them. The sheet 307 is also held in the correct position by its ends which bear on the cross-pieces 207, 207' of the lower sheet which supports it, the whole being constructed in such a way that the two sheets can easily be detached from each other when necessary for the periodic rapid cleaning of the grids 7, 7'. Each grid 7, 7' bears on the longitudinal edges of an intake 6, 6' with its lower sheet 107 which has a cross-piece 407 fixed underneath it for bearing on the outer side of the highest edge of the said intake 6, 6', the whole being constructed in such a way that the said grids remain stably in the position in which their upper cross-pieces 207, each provided in its median area with a handle 507, are located outside the upper parts of the suction intakes, and their cross-pieces 207' are located outside the lower parts of the said intakes, each of the latter cross-pieces being located above the conveyor 4 and having discharge apertures 607 adjoining the lower vertices of the corrugated sheets 107 and 307. The grids 7, 7' are completed with identical and equidistant holes 707 over their whole extensions and in the mid-lines of the channels of the upper sheet 307, and with identical and equidistant holes 707' in the upper parts of the corrugations of the lower sheet 107, these holes being staggered with respect to each other as shown in detail in FIG. 6, in such a way that the flow of air sucked in by the intakes 6, 6' is forced to pass along a labyrinthine path through the holes of the grids 7, 7', so that it is made to contact the whole surface of the grids in question and to deposit the paint mist on these grids, both as a result of the surface contact and as a result of the collision which causes the droplets of paint to be deposited on the sheets 107, 307, where the accumulated paint flows by gravity along the lower corrugations of these sheets and falls onto the conveyor 4 through the holes 607 and the cross-piece 207' which acts as a drip strip. In a variant embodiment which is not illustrated, at least the lower sheet 107 incorporated in the filter grid 7, 7' can be free of holes 707' in the portion which projects from the suction intakes and which is located on the conveyor 4 of the spraying machine. For additional assistance in preventing the soiling of the outer and lowest parts of the suction intakes or of the surfaces between these and the conveyor 4, the lower sheet 107 of each filter grid 7, 7' can be provided below with a cross-piece acting as a drip strip, which reproduces the corrugated profile and which projects downwards inside the suction intake, slightly in front of the lowest edge bearing on the intake.

FIG. 2 shows that the chamber 1 is provided, near the filter grids 7, 7', with hatches 201, 201' to provide access to these grids. At the end of the working day, when the machine is stopped, in order to prevent paint from dripping from the grids 7, 7' onto the stationary conveyor 1, the said hatches are opened and the grids 7, 7' are withdrawn by means of the handles 507 and are positioned with their perforated end cross-pieces 207' inside the intakes 6, 6', as illustrated in broken lines, in such a way that the residual paint on the said grids drips into these intakes, to prevent excessive accumulation of paint on the conveyor 4 when it is stationary.

FIG. 2 also shows how filters 9, 9', formed for example from panels with fibres of synthetic material or chips of metal or other suitable material, are housed removably and in an inclined arrangement with their ends supported in seats 8, 8' located under the longitudinal sides of the said intakes, at least in the upper parts of the suction intakes 6, 6', these filters additionally contributing to the capture of droplets of paint contained in the mist sucked from the chamber 1. Clearly, other filters, whether self-cleaning or not, again preferably in an inclined position and removable to allow periodic cleaning, can be housed in the suction intakes 6, 6'.

Figure 3:
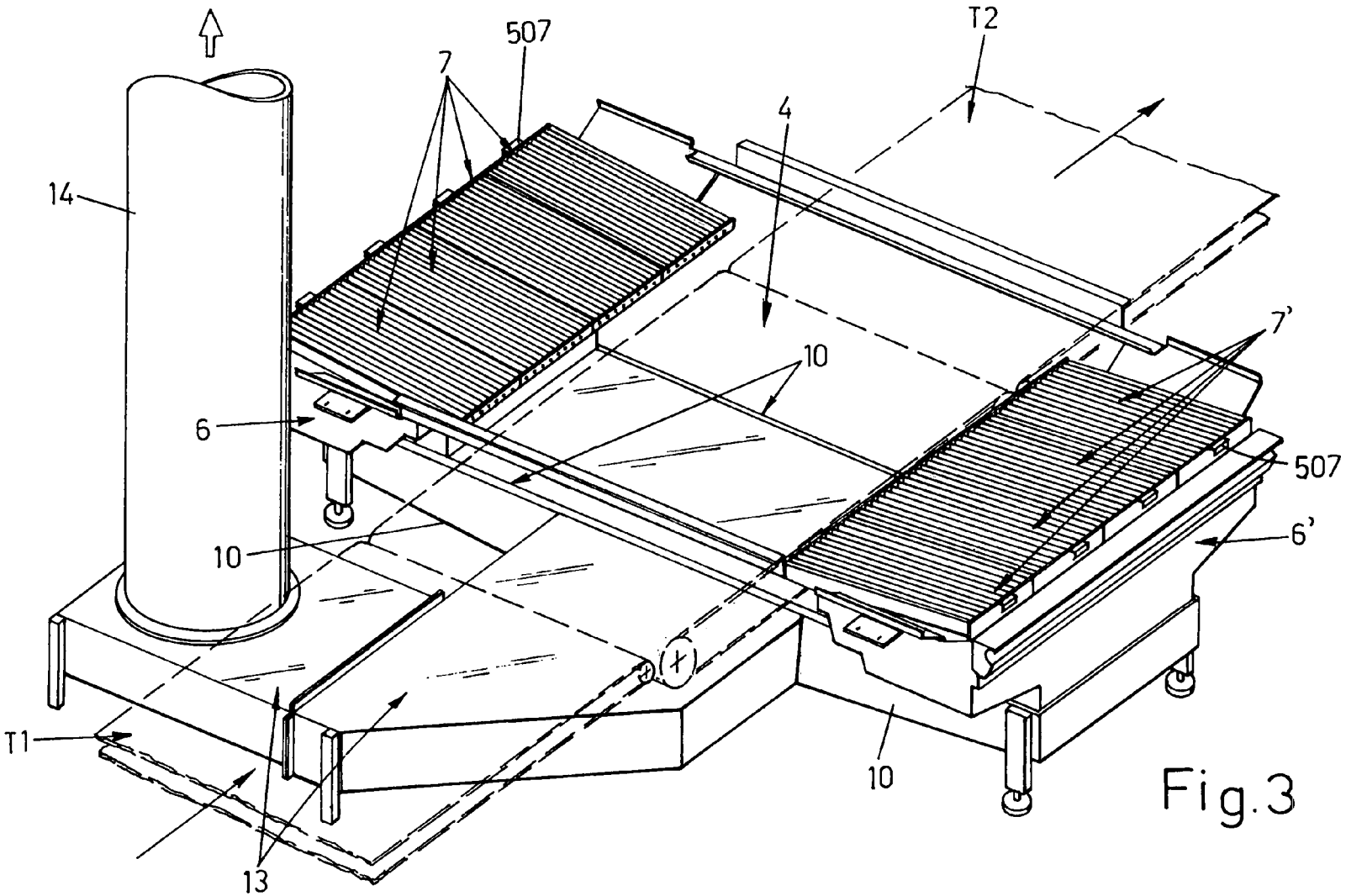
FIG. 3 is a perspective view of the recovery system.

The suction intakes are made in the form of hoppers, in such a way that all the paint falling onto their inner surfaces flows downwards by gravity. FIGS. 1, 2 and 3 show that the lower ends of the suction intakes 6, 6' are connected to each other by a boxlike collector 10 of predominantly horizontal extension, made for example with a metal framework and positioned transversely under the conveyor 4 of the spraying machine. The lower wall 110 of the collector 10 is made in such a way that it converges towards a central lower area connected by a suitable discharge tube 111 to a tank 11 into which all the paint falling from the suction intakes and from the self-cleaning filters located therein flows by gravity, this tank being made removable for period emptying and/or being provided with suction means for the automatic extraction of the collected product.

The collector 10 is provided in the middle of its side with an aperture 12, of rectangular section for example, connected to a duct 13 which is also boxlike and has a predominantly horizontal extension, made for example with a metal framework, and which in plan view is L-shaped so that its end opposite to that connected to the aperture 12 is positioned laterally with respect to the conveyor T1 of the spraying machine, for connection to the lower end of an ascending duct 14, having a suitable round section for example and of appropriate length, which terminates at its top in at least one bend 15 connected to the suction intake of a centrifugal fan 16 of suitable capacity, positioned with its axis horizontal or vertical, and having its discharge outlet 116 discharging directly into the atmosphere if required, outside the building in which the machine in question operates. Finally, FIG. 1 also shows that the very small residual amount of paint drops suspended in the air reaching the fan 16 is made to precipitate in contact with the blades of this component and by centrifuging onto the fan casing, which can be covered internally with a porous surface to enhance the precipitation and retention of the product to be recovered, which flows into the lower part of the said casing into which opens a drainage duct 17 which discharges by gravity into the duct 13 or into another suitable position close to the collecting tank 11. The lower wall 113 of the duct 13 is also inclined progressively downwards towards the tank 11, in such a way that all the paint falling from this duct and from the subsequent ducts 14 and 15 flows into the said tank.

If required by the nature of the product to be recovered, the duct 13 can contain filters of the self-cleaning or other type, in a cassette arrangement, in such a way that they can be pulled out when necessary for periodic cleaning, the whole being arranged in a way which can be readily understood and implemented by a person skilled in the art. In order to increase the purifying capacity of the system even further, all of its surfaces which are located at the points of deflection of the flow of sucked air and whose contact with the said flow tends to be greater than that of other surfaces, for example the part of the inner walls of the collector 10 underneath the intakes 6, 6' (FIG. 2), the angled inclined wall of the duct 13 (FIG. 3), and the wall with greatest curvature of the bend 15 (FIG. 2), can be provided, for example, with porous finned elements and/or can be provided with other known means for the precipitation of the paint droplets carried by the air.

What is claimed is:

1. Self-cleaning system for dry recovery of processing mists in automatic machines for spraying UV-dried acrylic paints or other products which give rise to similar requirements, of the type in which the chamber in which the spray guns operate is connected in its upper part to the atmosphere through a circuit for the admission of clean ambient air and in which, inside said chamber, at the sides of the self-cleaning conveyor for advancing the articles to be painted, there are suction intakes connected to an external fan of suitable capacity, with the interposition of suitable dry filter means, characterized in that said suction intakes are inclined transversely downwards towards said conveyor and are designed in such a way that filter grids with corrugated profiles can be positioned transversely on them, the grids being adjacent to each other, in such a way as to cover the whole extension of said intakes, the longitudinal axes of the corrugations being orientated orthogonally to the longitudinal axis of the conveyor on which the lower ends of the grids are positioned, in such a way that the paint retained by said grids, which are provided with suitably staggered holes for the passage of air, drips onto said conveyor which carries it away towards a cleaning and recovery means associated with the conveyor.

2. System according to claim 1, in which said filter grids are made from stainless steel or other suitable material.

3. System according to claim 1, in which each filter grid is provided on its underside with a cross-piece or other projecting means, which bears on the outside of the higher longitudinal side of the suction intake.

4. System according to claim 1, in which each filter grid is provided with at least one handle on its upper side, in such a way that it can be easily handled by the operators at various times, including times when the spraying machine is not operating and said grids are withdrawn and placed with their lower ends inside the suction intakes, the chamber of said machine being provided for this purpose with lateral hatches through which said grids can be accessed.

5. System according to claim 1, in which each filter grid comprises a lower corrugated sheet fixed at its ends to flat cross-pieces whose heights are greater than that of the corrugated profile of said sheet, in such a way that they project by a suitable distance above and below this sheet, so that a second corrugated sheet can be retained by bearing on the cross-pieces and is therefore removable when necessary, the corrugations of the second sheet having a larger angle than the corrugations of the lower sheet, in such a way that they are suitably spaced apart from them, said lower cross-piece being provided with discharge holes adjoining the lower vertices of the two corrugated sheets, the upper sheet being provided with equidistant holes in the lower vertices of its corrugations, while the lower sheet is provided with identical and equidistant holes in the upper parts of the flat faces of its corrugations, these holes being staggered with respect to the upper holes, in such a way that the flow of air sucked in by the intakes is forced to follow a labyrinthine path in passing through the perforated sheets of the filter grids, to contact the whole surface of these sheets and to deposit the paint droplets on them, both as a result of the surface contact and as a result of precipitation, the paint collected by the two sheets of the grids being made to flow by gravity along the corrugations of these sheets and fall onto the conveyor through the holes of the lower end cross-piece which also acts as a drip strip.

6. System according to claim 5, in which the two corrugated sheets making up each filter grid have identical corrugation pitches.

7. System according to claim 5, in which the lower corrugated sheet of each filter grid has corrugations with an angle of less than 90°, while the upper corrugated sheet of said grids has corrugations with an angle of approximately 90°.

8. System according to claim 7, in which the lower corrugated sheet of each filter grid has corrugations with an angle of 40°.

9. System according to claim 5, in which at least the lower sheet of the filter grid can be free of holes in the portion which projects from the suction intakes and which is located on the conveyor of the spraying machine.

10. System according to claim 5, in which the lower sheet of each filter grid can be provided in its lower part with a cross-piece which reproduces its corrugated profile and which projects downwards into the suction intake, before the lowest edge which bears on said intake, this cross-piece acting as a drip strip.

11. System according to claim 1, in which at least the upper parts of the suction intakes contain removable and preferably inclined filters of the self-cleaning or other type, through which the flow of air passes, and which also contribute to the capture of the paint droplets contained in the mists sucked from the spraying chamber.

12. System according to claim 11, in which said inclined filters are panels made with fibers of one of synthetic material or metal chips.

13. System according to claim 1, in which the lower ends of the suction intakes are connected together by a boxlike collector having a predominantly horizontal extension, positioned transversely and under the conveyor of the spraying machine, the lower wall of the collector being such that it converges towards a central lower area in which is located a tank, into which all the paint falling from the suction intakes and from the filters located therein tends to flow by gravity, and which can be designed to be removable for periodic emptying or which can be provided with suction means for automatic extraction of the collected product, the intermediate part of said collector being made with a lateral aperture connected to a duct, also boxlike and having a predominantly horizontal extension, which in plan view appears L-shaped so that its end opposite that connected to said aperture is positioned at the side of the external conveyor of the spraying machine, for connection to the lower end of an ascending duct, also of appropriate length, which preferably terminates at its top in at least one bend connected to the suction intake of a fan which discharges into the atmosphere, the lower wall of said duct being made inclined with a progressive descent towards said tank, in such a way that all the paint flowing from this duct and from the downstream duct flows into said collecting tank.

14. System according to claim 13, in which said fan is of the centrifugal type and is designed in any suitable way to recover the residual paint droplets contained in the air by precipitation on the blades of the fan and by centrifugal force, the casing of this component being covered or internally structured with a porous surface if necessary, to enhance the precipitation and retention of the paint, and being provided in its lower part with a trap in which the recovered paint is collected and which opens into a drainage duct which discharges by gravity into any lower part of the system, near said collecting tank.

15. System according to claim 1, in which, if required by the nature of the product to be recovered, self-cleaning filters can be positioned in a cassette arrangement in the accessible horizontal part of said system, in such a way that the filters can be withdrawn when necessary for periodic cleaning.

16. System according to claim 1, in which the inner surfaces of the system which are located at a point of deflection of the flow of air sucked in and which tend to be in contact with said flow to a greater extent than other surfaces, can be provided for example with finned porous inserts or other known means for precipitating the paint particles carried by the air.

* * * * *